US007137456B2

(12) United States Patent
Moses

(10) Patent No.: US 7,137,456 B2
(45) Date of Patent: Nov. 21, 2006

(54) FIREFIGHTING EQUIPMENT

(76) Inventor: Linnie L. Moses, Route 2, Box 324, Potosi, MO (US) 63664

( * ) Notice: Subject to any disclaimer, the term of this patent is extended or adjusted under 35 U.S.C. 154(b) by 0 days.

(21) Appl. No.: 11/070,935

(22) Filed: Mar. 3, 2005

(65) Prior Publication Data

US 2005/0199402 A1 Sep. 15, 2005

Related U.S. Application Data

(60) Provisional application No. 60/551,707, filed on Mar. 10, 2004.

(51) Int. Cl.
*A62C 31/22* (2006.01)
*A62C 27/00* (2006.01)

(52) U.S. Cl. ..... 169/70; 169/24; 239/272; 239/271

(58) Field of Classification Search ..... 169/70, 169/24, 13, 52, 54; 239/272, 271, 146, 172, 239/175, 176, 276, 587.2, 587.5; 173/184, 173/185; 180/41; 280/4, 6.154
See application file for complete search history.

(56) References Cited

U.S. PATENT DOCUMENTS 2,251,175 A * 7/1941 Tappe ..... 169/67
2,857,005 A * 10/1958 Medlock ..... 169/62
3,104,720 A * 9/1963 Sullivan ..... 169/25
3,865,194 A * 2/1975 Chatfield, Jr. ..... 169/70
4,271,909 A * 6/1981 Chatfield et al. ..... 169/70
4,834,215 A * 5/1989 Smeal ..... 182/66.2
5,301,756 A * 4/1994 Relyea et al. ..... 169/24
5,461,874 A * 10/1995 Thompson ..... 62/60
6,446,731 B1 * 9/2002 Sorosky ..... 169/24
6,755,259 B1 * 6/2004 Peltola et al. ..... 169/47
6,811,161 B1 * 11/2004 Anderson ..... 280/4
6,840,330 B1 * 1/2005 Lancaster ..... 169/70

* cited by examiner

*Primary Examiner*—David A. Scherbel
*Assistant Examiner*—Darren Gorman
(74) *Attorney, Agent, or Firm*—Polster, Lieder, Woodruff & Lucchesi, L.C.

(57) ABSTRACT

An articulated fire truck (T) has an extendible and retractable boom (11) mounted on the truck and extendible to a height above the ground where a fire is burning within a building (B). A drill assembly (1) is affixed to the end of the boom for drilling through a sidewall of the building into the building's interior. The drill assembly is maneuverable to drill straight through the sidewall as well as up and down and sideways so to provide an opening into the interior of the building sufficiently large that a nozzle attached to the drill assembly can readily spray water or a fire retardant material into the interior to extinguish the fire. The drill assembly has drill bits (100) located completely about the circumference of the drill assembly to facilitate up-and-down and side-to-side cutting to more quickly penetrate into the building's interior.

9 Claims, 3 Drawing Sheets

FIREFIGHTING EQUIPMENT

CROSS REFERENCE TO RELATED APPLICATIONS

This application is based upon Provisional Patent Application 60/551,707 filed Mar. 10, 2004.

STATEMENT REGARDING FEDERALLY SPONSORED RESEARCH OR DEVELOPMENT

Not applicable

BACKGROUND OF THE INVENTION

This invention relates to mobile firefighting equipment such as a fire truck equipped to fight fires in tall buildings; and more particularly, to a retrofitted or original equipment (OE) fire truck employing the equipment to breach walls on both the outside or the inside of a building. When the walls are breached, water or a fire retardant gas or foam is sprayed through in-line and/or peripheral nozzles onto a fire to extinguish it.

Fighting fires in tall buildings is extremely difficult. Depending on the location of the fire (i.e., on a streetside of the building where the fire is accessible, or away from a streetside where it is not), positioning fire fighting equipment close enough to the location of the fire so to be effective in fighting it can be very difficult, and sometimes impossible. Fire trucks are available whose hoses are extendible to great heights so water or a fire retardant material can be directed at a fire to either control or extinguish it. However, the ability to extend a hose to an appropriate height does not mean the water will reach the fire. This is because many times the exterior of the building must first be breached. If a window has been blown or knocked out, or if a side of the building has partially collapsed, water can be directed at the fire through the opening. But if this hasn't happened, then the hose must be trained on a window in the hope that water pressure will knock out the window and provide the necessary access to the fire.

Further, even when it is possible to direct water into a building at a great height, this does not mean the water will reach the fire. If the fire is located away from the opening into which water is directed, the water may not reach the fire and will no therefore be very effective in putting out the fire. Rather, any intervening walls or partitions between the opening into which water is sprayed and the fire must first be breached so the water can reach and extinguish the fire. Otherwise, the best that be hoped for is that the water directed at that floor will keep the fire from spreading. Overcoming these obstacles has heretofore been difficult to do, if at all, unless firefighters can reach the floor and breach the walls and partitions with pickaxes, spiked poles, or other equipment.

Besides these problems, another difficulty is that fire trucks, especially those used in metropolitan areas, are currently not designed for off-road use. That is, they generally must remain on a street and cannot readily be driven close to a building which is setback from the street any appreciable distance and erected on a hill, for example. Accordingly where the building is not adjacent a street, or there is an elevation change between street level and the building, it becomes significantly more difficult to fight a fire in the building.

The present invention addresses these problems.

BRIEF SUMMARY OF THE INVENTION

The present invention is directed to firefighting equipment. A fire truck includes a telescopically mounted fire hose assembly which is extendible to heights sufficient to reach the upper stories of most buildings. A swivel mount is affixed to an outer end of the assembly so water from the hose can be appropriately directed at a fire. A drill bit fitted on the outer end of the assembly is positioned against an outside wall of the building to breach the wall and expose the interior of the building to a spray of water from the hose. The drill bit comprises a pair of counter-rotating bits to speed up drilling through the wall. The drill bit incorporates a spray nozzle by which water can be sprayed from both the end and sides of the nozzle. A high pressure spray emanating from the nozzle not only has a force sufficient to project water well into the floor, but the water pressure is also sufficient to breach plasterboard walls, partitions, and the like, so the water reaches the area where the fire is located. The hose assembly can either be original equipment on new fire trucks or retrofitted onto existing fire trucks.

In another embodiment of the invention, the fire truck is an articulated vehicle with a pusher blade attached to its front end. The blade and articulated vehicle construction allows it to be an effective "off road" vehicle capable of moving obstacles out of the way of the fire truck and enabling the truck to traverse terrain conventional fire trucks are unable to traverse to better enable the truck to reach previously inaccessible areas to fight a fire.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings, which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 2:
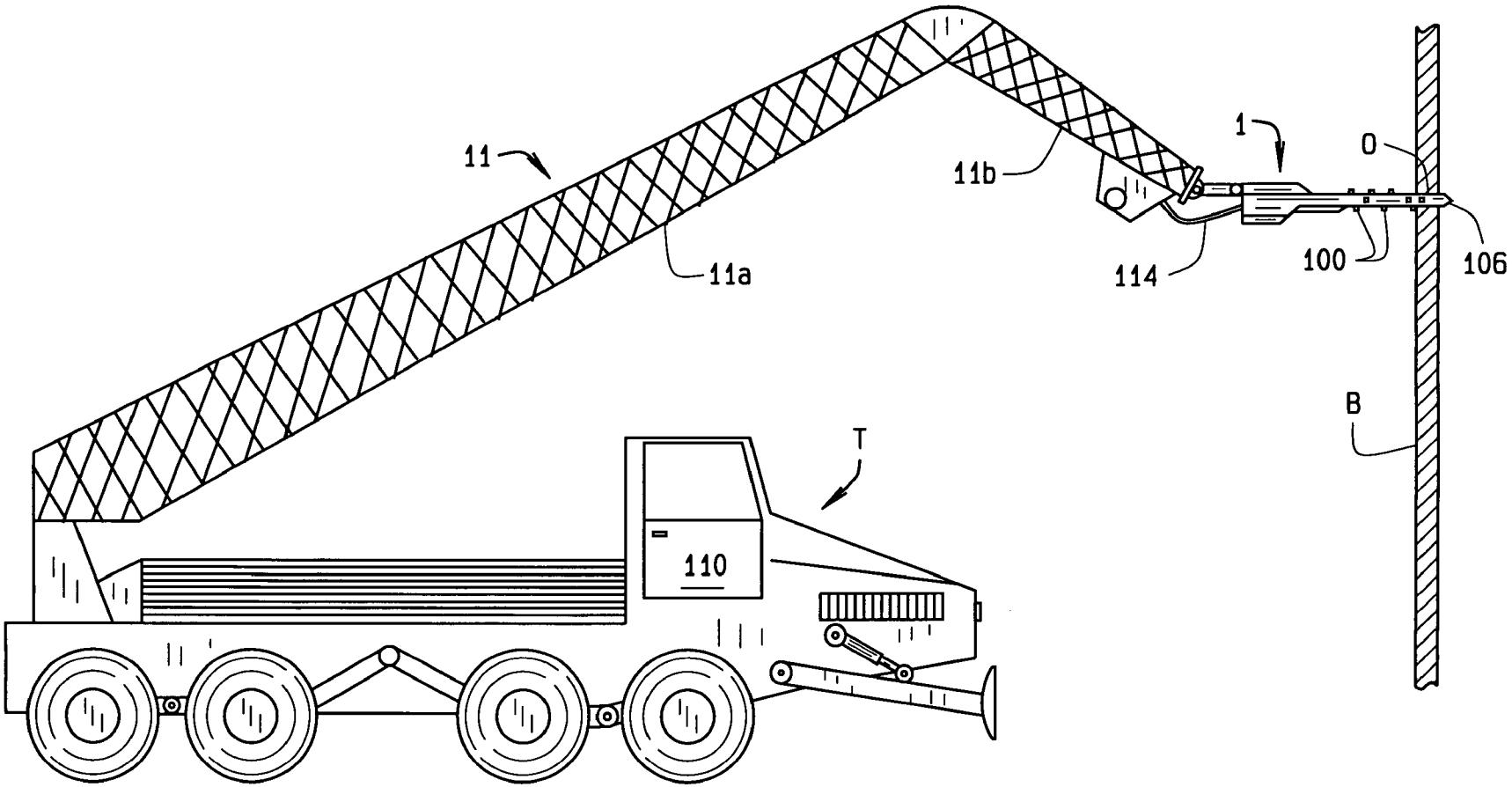
FIG. 2 is a view similar to FIG. 1 with the hose assembly in an extended position; and, FIGS. 3A and 3B are views of the nozzle end of the hose assembly showing both cutter bits for breaching a wall and spray outlets for directing water or a fire retardant at a fire.
Figure 3A:
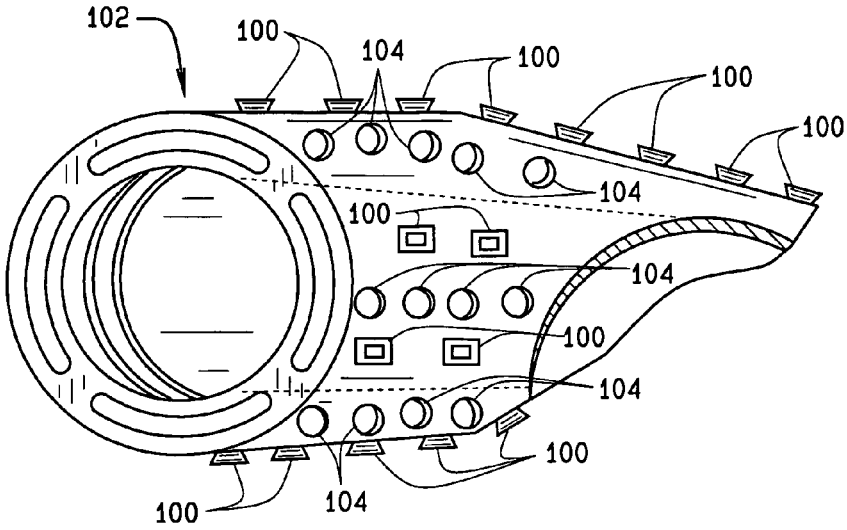
Figure 3B:
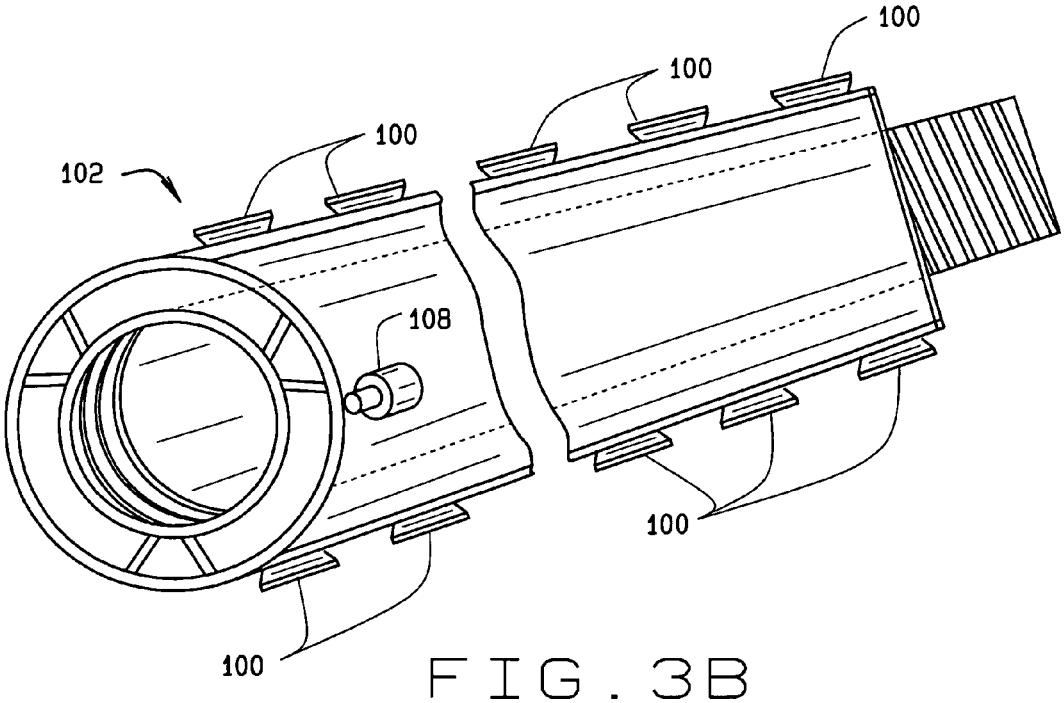

Referring to the drawings, an articulated fire truck T of the present invention includes a three-in-one remote control nozzle assembly indicated generally 1. The nozzle assembly provides a hammer drill with a side cutting capability combined with a high-pressure water gun. When extended against the side of a building B, as shown in FIG. 2, an assembly operator activates a hammer drill rotary motor unit 2 to activate the drill. Further, by use of an all-directional mount drill head 3, the hammer drill is placed against the outside of building B, in an appropriate orientation. Thereafter, operation of assembly 1 drives the drill portion of the assembly into and through the side of the building, piercing the sidewall of the building and making an opening 0 into the building. The drill portion of the assembly is effective for use against a wide range of building materials, so it makes no difference if the sidewall is of an aggregrate material such as concrete, or if the sidewall is of a metal construction, or wood, or glass. As shown in FIGS. 3A and 3B, drill bits 100 are located completely about the circumference of a nozzle end 102 of assembly 1. This allows the nozzle assembly to move not only in-and-out, but also laterally and up-and-down (side cutting), to more penetrate into the building as quickly as possible. Nozzles 104 formed in the side of the nozzle end 102 provide cooling water to the assembly while it is cutting or hammering.

Because time is of the essence in fighting a fire, both to prevent human casualties and minimize property loss, quickly breaching the building sidewall allows water, or a fire retardant foam or gel, to be rapidly brought to bear against the fire. In this regard, it will further be understood that assembly 1 is extendible into building B, once it is breached, so hammer drill and side cutting capabilities of the assembly can be used to penetrate interior walls and partitions to better get at the fire. The extension of assembly 1 into building B is accomplished by extending the boom 11 on the end of which assembly 1 is attached.

Further with respect to drill head 3, it includes a rotary hammer motor, together with an interchangeable drill rod tube and end bit 106. The drill rod tube serves as a water nozzle with a side cutting and end drilling capability combined all into one unit. The drill tube and end bit are manufactured with hardened tips such as carbide or diamond tips. These cutting elements are installed in a spiral configuration on the outer face of nozzle assembly The side-to-side cutting capability of nozzle assembly 1 is an important feature of the invention. Up until now, even if a building sidewall could be breached, the resulting opening was very small and the amount and direction in which water could be sprayed into the building through the opening was relatively small. The side cutting capability of nozzle assembly 1 now allows any opening in the building made by drill to be rapidly enlarged. This is important because an enlarged opening allows assembly 1 to be extended well into the building rather than being limited just to the opening made in the building sidewall. Since the drill portion of the assembly can also cut through interior walls and partitions, the nozzle can, in many instances, be brought very close to the fire. This then allows a substantially greater volume of water to be directed onto the fire increasing the chances of putting out the fire with less risk to firemen having to go into the building. Nozzle assembly 1 be guided through a large range of motion from an operator on the ground to direct water where it is most needed. If necessary, at ground level, nozzle assembly 1 is advantageously used to drill openings into the sidewall and then rapidly expand them to create entrances into the building for fire fighting, medical, and other emergency personnel.

To pinpoint the location of a fire, so nozzle assembly 1 can be quickly and accurately positioned, an infrared imaging device 4 is mounted atop cab 110 of fire truck T. Thermal imagery provided by the device is displayed on the viewing screen of a head's up display 5 within cab 110. The display assists both the driver of truck T, by helping him best position the truck, and a nozzle assembly operator, by helping him best position the boom on which nozzle assembly 1 is attached, so water to put out the fire is accurately directed at the fire and not wasted. This "heads up" display capability also includes a closed circuit TV (CCTV), in addition to the infrared or other thermal imaging sensors of device 4. The CCTV includes a camera 108 mounted on assembly and providing visual images of the interior of building B and location of the fire. Besides device 4, the operator also acquires information from other personnel or equipment (fire trucks, planes, helicopters) remote from fire truck T. These auxiliary information sources aid the operator in identifying where to best employ assembly 1 to extinguish the fire. For example, an airborne sensor can relay thermal imagery to the operator which identifies "hot spots" the operator could not otherwise identify because of the fire truck's position.

To operate the boom and nozzle assembly 1 and help pump water up boom 11 to the nozzle assembly, a power pack and hydraulic pump assembly 6 are mounted on the end of the boom, adjacent the nozzle assembly. The power back provides electrical energy to the nozzle assembly to control movement of the assembly in its six directions of possible movement. The hydraulic pump insures that sufficient water is pumped through nozzle assembly 1 and that the spray pressure of the water is sufficient for the water to reach the flames. In this latter regard, primer pumps 7 are also installed on fire truck T. The primer pumps produce sufficient force to pump water to hydraulic pump assembly 6, regardless of how far boom 11 has been extended. Accordingly, even if boom 11 is at its fullest extent, water will reach hydraulic pump assembly 6 so it can be pumped through nozzle assembly 1 will enough force to reach the fire. Primer pumps 7 are reversible pumps so if too much water is being pumped to the hydraulic pump assembly 6, or if an emergency occurs, water flow to nozzle assembly 1 can be quickly reversed. The primer pumps also are used to drain water from a fire hose in order to pump a foam for electrical or chemical fires.

Figure 1:
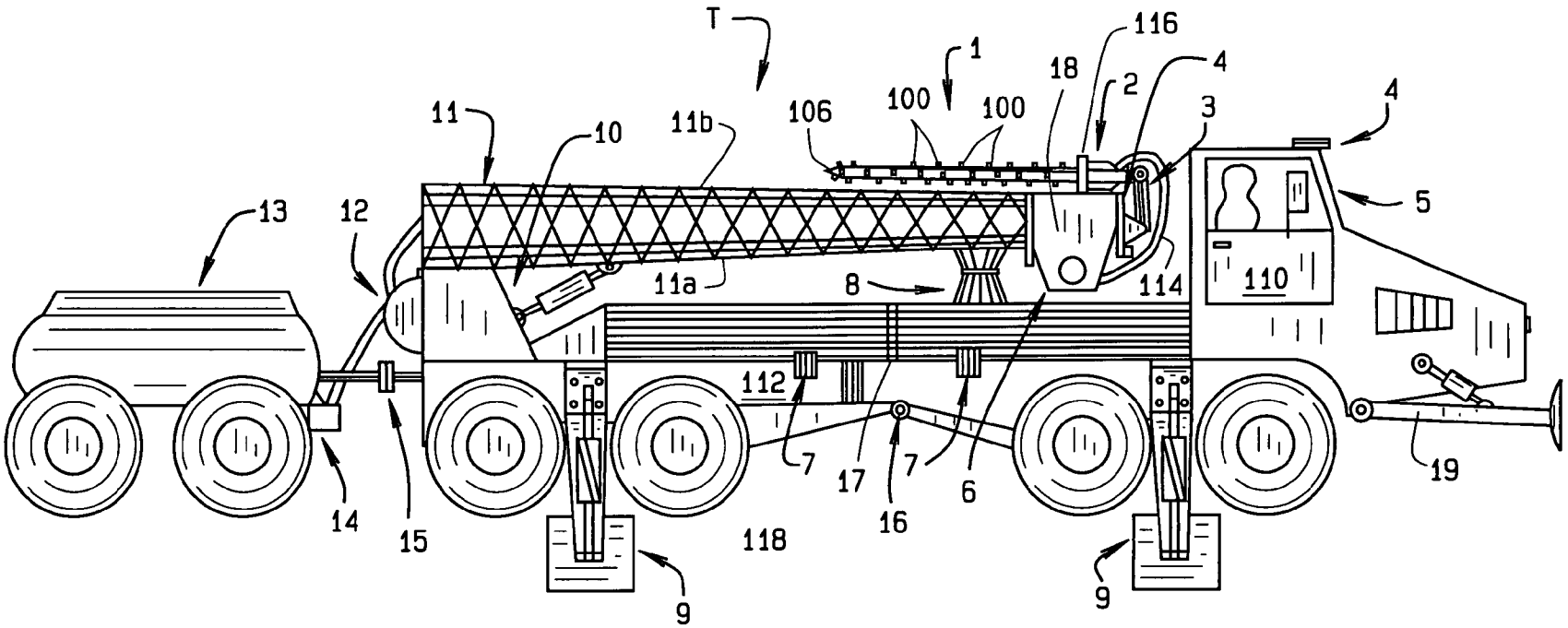
FIG. 1 is an elevation view of a fire truck and hose assembly of the present invention with the hose assembly in its retracted position.

Fire truck T is driven from its firehouse to the location of the fire with nozzle assembly 1 and boom 11 retracted as shown in FIG. 1. It is important that, while traveling to the fire, that the nozzle assembly and boom are not damaged. For this purpose, the nozzle assembly and boom, in their retracted state, are supported by a swivel mount 8 installed on the back of the fire truck. Once at the fire scene, and before extending the boom and nozzle assembly, automatic self-levelers or stabilizers 9 are extended from beneath truck frame 112 to stabilize and level the fire truck. This insures that even if fire truck T sits on an incline, the vehicle and base of boom 11 are level. This, in turn, makes it easier to control the extension and retraction of the boom and maneuvering of nozzle assembly 1, thereby preventing the boom and nozzle assembly from twisting or skewing or being subjected to unnecessary forces which would make it difficult to position the nozzle assembly and keep it in place. Further, a hydraulic shock absorber 10 extends between the base of boom 11 and frame 112 to further stabilize the boom and nozzle assembly 1 and keep them from being damaged by shocks and vibrations.

Boom 11 is a telescoping boom and is extendible and retractable as shown in FIGS. 1 and 2. Those skilled in the art will understand that while only two boom sections 11*a* and 11*b* are shown in the drawings, the boom may have additional sections depending upon how high nozzle assembly 1 is to reach. A hose 114 which connects to nozzle assembly 1 is routed through boom 11 from a "no slack" hose reel 12. An inlet end of hose 114 attaches to an outlet of a fire hydrant (not shown), or to an all terrain trailer tank 13 towed by the fire truck and which holds a large quantity of water. A battery powered primer pump 14 pumps water from trailer tank 13 into hose 114. The trailer tank attaches to the fire truck by a remote control hitch 15 which can be remotely released from within cab 110 to separate the tank from the fire truck.

Other features of the fire truck include a center pivot lock 16 used to lock the wheels of the fire truck whenever the stabilizers 9 are used. This prevents the truck from rolling, especially if it is parked on an incline. Also, a storage tank 17 is mounted beneath truck frame 112. Water or fire retardant chemicals stored in this tank are pumped through hose 114 and nozzle assembly 1 into the building. A seal 116 is located between the downstream end of hose 114 and nozzle assembly 1 to prevent backflow of a fire retardant chemical pumped from tank 17. Next, an automatic tool changer 18 is installed immediately adjacent nozzle assembly 1. The changer facilitates replacement of parts of the nozzle assembly, as well as the nozzle assembly itself if it is damaged.

An important feature of fire truck 1 is that frame 112 is articulated, as indicated at 118, so the fire truck can more readily move over uneven terrain. The articulation can be accomplished in different ways. For example, a section of the frame is made of a high-strength, flexible metal which bends or flexes as the truck is driven over uneven terrain. Regardless, the articulation, besides allowing increased mobility, insures that boom, nozzle assembly, and other operational parts of the fire truck are not damaged or unduly stressed as the truck is driven to where it is needed. To further assist movement of fire truck T, a hydraulically controlled blade 19 is mounted on the front end of the truck. In urban areas, the blade is used to push automobiles, for example, blocking the truck's path to a fire scene out of the way. In off-road situations, the blade is used to push away small trees and brush blocking the truck's path to the scene of a fire.

In view of the above, it will be seen that the several objects and advantages of the present invention have been achieved and other advantageous results have been obtained.

What I claim as my invention is:

1. An improved fire truck comprising:

an extendible and retractable boom mounted on the truck, the boom being extendible to a height above the ground where a fire is burning within a building;

a drill assembly affixed to the end of the boom for drilling through a sidewall of the building into the building's interior, the drill assembly being maneuverable to drill not only straight through the sidewall, but also up and down and side-to-side to provide an opening into the building, and which the drill assembly includes drill bits located completely about the circumference of the drill assembly to facilitate up-and-down and side-to-side cutting to more quickly penetrate into the building's interior; and, a nozzle attached to the drill assembly for spraying water or a fire retardant material into the interior to extinguish the fire.

2. The improved fire truck of claim 1 which is an articulated truck movable over uneven terrain.

3. The improved fire truck of claim 1 in which the boom is extendible into the interior of the building through the breach for the drill assembly to penetrate interior walls and partitions so the nozzle can be positioned sufficiently near the fire to spray water on the fire.

4. The improved fire truck of claim 1 further including a hose extending from a source of water to the nozzle for pumping water onto the fire through the nozzle, and a reversible pump for pumping the water from the source to the nozzle, the pump being reversible to drain water from the hose in the event of an electrical or chemical fire so a fire retardant can be pumped through hose for spraying onto the fire through the nozzle.

5. The improved fire truck of claim 1 further including thermal imaging means for locating the fire and facilitating an operator to direct the drill assembly to the location where breaching the building sidewall would best enhance spraying water on the fire.

6. The improved fire truck of claim 5 further including visual imaging means mounted on the drill assembly for providing visual images of the interior of the building.

7. The improved fire truck of claim 1 further including automatic self-leveler means extending from beneath a frame of the fire truck frame to stabilize and level the fire truck when the fire truck sits on an incline.

8. The improved fire truck of claim 7 further including a center pivot lock for locking wheels of the fire truck when the self-leveler means are in use.

9. The improved fire truck of claim 2 including a frame having a section made of a flexible metal which bends or flexes as the truck is driven over uneven terrain.

* * * * *